US005590609A

United States Patent [19]

Ramachandran et al.

[11] Patent Number: 5,590,609

[45] Date of Patent: Jan. 7, 1997

[54] ENVELOPE DISPENSER DOOR MECHANISM FOR AUTOMATED TELLER MACHINE

[75] Inventors: Natarajan Ramachandran, Uniontown; Kim R. Lewis, Stow; Richard C. Lute, Jr., Mogadore, all of Ohio

[73] Assignee: InterBold, North Canton, Ohio

[21] Appl. No.: 316,703

[22] Filed: Sep. 30, 1994

[51] Int. Cl.[6] ..... E05G 1/04

[52] U.S. Cl. ..... 109/59 R; 109/19; 109/66; 902/9; 194/351; 232/44

[58] Field of Search ..... 109/58–63.5, 64, 109/66, 73, 75, 15–19, 22–24.1, 45, 46; 902/8, 9, 14, 36; 271/2; 194/351; 232/44; 292/144, 201, DIG. 46; 221/154, 303, 306, 309; 70/57, 58, 95, 158, 170–173, 277

[56] References Cited

U.S. PATENT DOCUMENTS

| | | | |
|---|---|---|---|
| 2,604,967 | 7/1952 | Murtaugh, Jr. | 109/24.1 |
| 3,092,433 | 6/1963 | Simjian | 902/9 X |
| 3,465,955 | 9/1969 | DeBoer et al. | 902/9 X |
| 3,783,989 | 1/1974 | Jensen | 194/351 X |
| 3,866,235 | 2/1975 | Maynard et al. | 109/66 X |
| 3,933,382 | 1/1976 | Counts et al. | 70/280 X |
| 4,092,934 | 6/1978 | Sayer | 902/9 X |
| 4,176,610 | 12/1979 | Markham et al. | 109/59 R |
| 4,251,009 | 2/1981 | McLaughlin et al. | 109/19 X |
| 4,393,789 | 7/1983 | Glotfelter | 109/19 |
| 4,570,548 | 2/1986 | Martin et al. | 109/66 |
| 4,782,674 | 11/1988 | Johnson | 292/DIG. 32 X |
| 4,919,058 | 4/1990 | Isozaki et al. | 109/66 X |
| 4,949,651 | 8/1990 | Frank et al. | 109/24.1 |
| 5,052,730 | 10/1991 | Frank et al. | 109/24.1 X |
| 5,184,489 | 2/1993 | Squires et al. | 70/58 |

FOREIGN PATENT DOCUMENTS

| | | | |
|---|---|---|---|
| 2397688 | 3/1979 | France | 109/17 |
| 606734 | 11/1978 | Switzerland | 109/17 |

*Primary Examiner*—Suzanne L. Dino
*Attorney, Agent, or Firm*—Ralph E. Jocke

[57] ABSTRACT

An envelope dispenser (50) for use in an automated teller machine includes a lockable access door (14). The door includes a slot (20), integral with its first face (16). The door is locked by the engagement of a first member (36) in a first notch portion (24) of the slot. The door is unlocked by an actuator (46) which upon the receipt of an electrical signal moves the first member into a central portion (28) of the slot. In this position the door may be manually moved to a fully open position by a user. In the open position the actuator urges the first member into a second notch portion (26), which releasably holds the door in the open position. In the open position envelopes stored in the machine may be accessed. From the open position the door can either be manually closed or automatically closed by the cessation of the electrical signal which enables a spring (44) to move the first member to the central portion of the slot. Once the door is returned in the closed position and the actuator de-energized, the first member returns to the first notch portion again locking the door.

35 Claims, 4 Drawing Sheets

ENVELOPE DISPENSER DOOR MECHANISM FOR AUTOMATED TELLER MACHINE

TECHNICAL FIELD

The present invention relates generally to access doors and, more particularly, to an envelope dispenser used in an automatic banking machine that includes a locking, sliding door which provides selective access to envelopes.

BACKGROUND ART

In recent years, there has been a substantial increase in the use of automated teller machines (ATMs). These machines have been used to both dispense money and to receive deposits. The deposits can consist of various sized checks, money orders, currency and the like. To accept the different sized paper in the apparatus, the ATM customer is often asked to utilize an envelope for holding the deposit. The machine often holds envelopes for this purpose which may be stored in a compartment in the machine. If this compartment is freely accessible, the envelopes in such a compartment can sometimes be stolen or vandalized.

In the past some ATMs have been equipped with a locking door limiting access to the envelope compartment. These doors in the prior art have been typically of two types. The first door is of the flip up variety, and the second is a slide door. The flip up door is often arcuate shaped and counter weighted, and utilizes directly linked actuation means to both open and close the door. Alternatively, flip up doors may be manually actuated. The flip up door can be bulky and takes up considerable space inside the machine. Some such doors may be prone to jamming due to the direct linkage and customers interfering with or opposing the force of the actuation means.

The slide door variety is also closed by directly linked actuation means and is maintained in position by a mechanism or frictional forces between the slide door and the frame of the door. The slide door is less bulky than the flip up door but may also be prone to jamming because of the direct linkage. In addition some slide doors are difficult to operate due to the friction between the door and the frame.

As a result, there exists a need for an access door for use in conjunction with an envelope dispenser for an automated teller machine that is compact, easy to operate, which cannot be jammed by customer error, and which can be locked in a closed position.

DISCLOSURE OF INVENTION

It is an object of the present invention to provide a dispenser for envelopes in an automated teller machine.

It is a further object of the present invention to provide a door for a dispenser for envelopes which is selectively lockable.

It is a further object of the present invention to provide a door for a dispenser for envelopes which may be releasably held in an open position.

It is a further object of the present invention to provide a dispenser for envelopes which cannot be readily jammed or rendered inoperable by error or tampering.

It is a further object of the present invention to provide a door for a dispenser for envelopes which can be closed from the open position at any time without damage.

It is a further object of the present invention to provide a dispenser for envelopes which is compact and easy to use.

Further objects of the present invention will be made apparent in the following Best Modes for Carrying Out the Invention and the appended claims.

The foregoing objects are accomplished in the preferred embodiment of the invention by an envelope dispenser used in an automated teller machine. The dispenser includes an envelope holder, which holds a supply of envelopes. The envelope dispenser is mounted inside the machine. The dispenser includes a frame, which is generally planar and rectangular. The frame has an opening which is sized greater than the width of an envelope, so that an envelope can easily be pulled through the opening by a customer.

The dispenser further includes a door which is sized to fit over the opening in the frame. The door has a first side which faces inward in the opening and a second side which faces the customer. The door is mounted on the frame so that it can slide longitudinally between a closed first position in which the door fully covers the opening and an open second position. The door further includes a handle on its second side which is manually engageable by the user of the ATM.

The first side of the door has a slot recessed and integral with the door. The slot has two notch portions, both extending transverse to the longitudinal direction. The first and second notch portions are disposed longitudinally from each other. The slot further includes a central portion that extends longitudinally between the two notch portions.

The dispenser also includes a second member slidably mounted on the frame. The second member is movable on the frame in the transverse direction between front, back and middle positions. The second member includes a pin mounted thereon. A first member is rotatably mounted on the pin of the second member.

When the door is in the first position, the first member is in the first notch portion of the slot. When the door is in the second position the first member is engaged in the second notch portion. When the door is positioned between the first and second positions, the first member is engaged in the central portion of the slot.

The dispenser further includes a spring which biases the second member towards the back position. An actuator is in operative connection with the second member. The actuator moves the second member and thereby moves the first member in the transverse direction against the force of the spring.

When the door is in the closed first position, the spring biases the second member into the back position. This biases the first member into the first notch portion, so that the door is locked. Force applied to the handle will not open the door. When the customer operates an input device of the ATM and indicates he intends to make a deposit which requires an envelope, the ATM generates an electrical signal which causes an actuator to move the second member into the middle position. As a result, the first member moves out of the first notch portion and into the central portion of the slot wherein the door can be moved in the longitudinal direction by the application of force to the handle of the door by the customer.

When the door is moved to the open second position, the actuator moves the second member into the front position as the first member moves from the central portion of the slot into the second notch portion. In this second position the door is releasably held open. If the user applies sufficient closing force to the handle, an obtusely angled surface between the second notch portion and the central portion of the slot allows the first member to be guided back against the force of the actuator into the central portion. This enables the door to be manually moved in the longitudinal direction to the closed position.

If the door is left in the second position by the customer, then upon the cessation of the electrical signal to the actuator, the force applied by the spring moves the second member into the middle position. As a result, the first member moves from the second notch portion of the slot into the central portion. This enables the door to move to the first position by gravity or other means. Upon reaching the closed position, the spring moves the second member to the back position and the first member moves from the central portion of the slot into the first notch portion. Once in the first notch portion the first member again prevents the door from being opened by a customer.

BEST MODES FOR CARRYING OUT INVENTION

Figure 1:
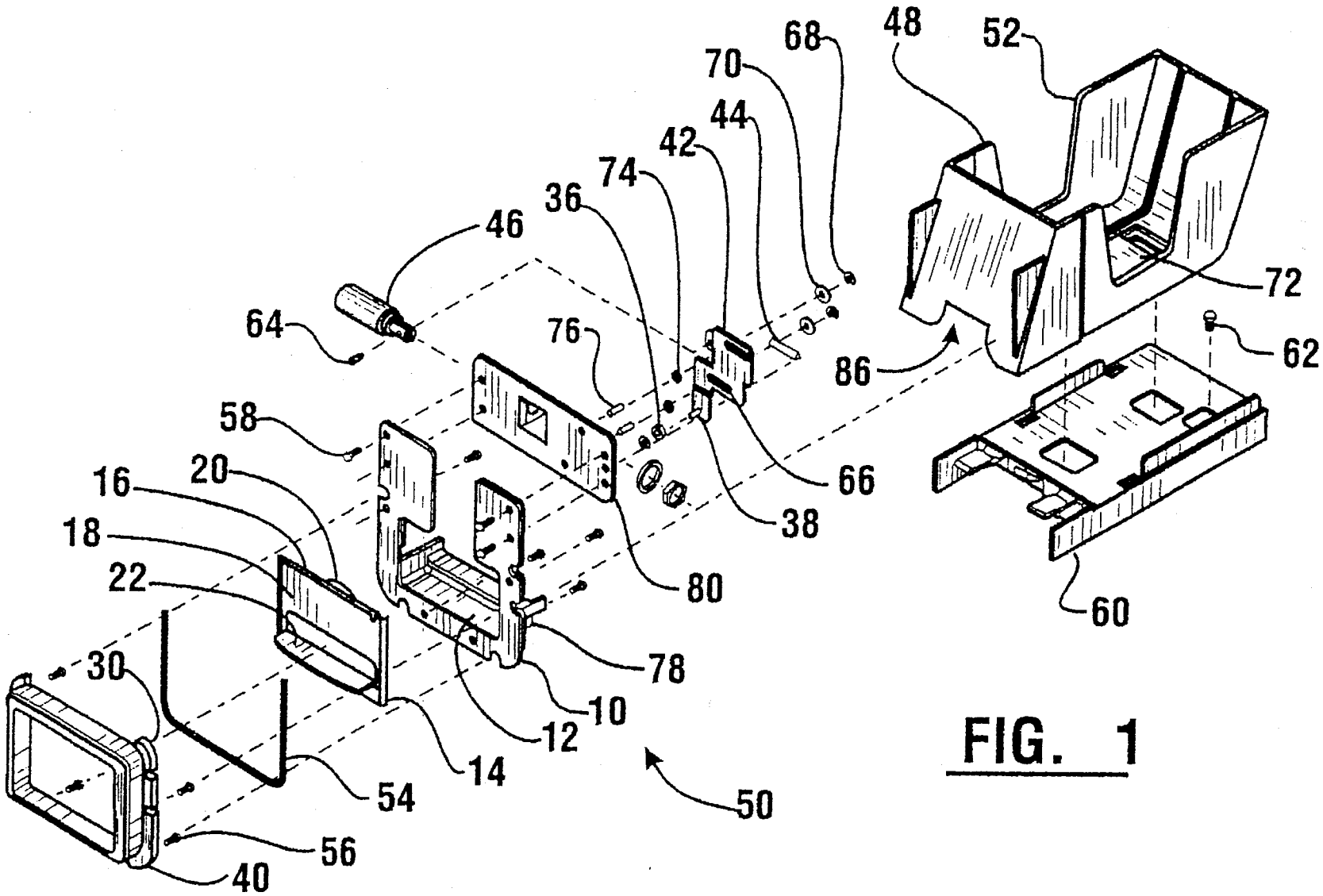
FIG. 1 is an exploded isometric view of the envelope dispenser of the present invention.

Referring now to the drawings and particularly to FIG. 1, there is shown therein the preferred embodiment of the envelope dispenser of the present invention generally indicated 50. The envelope dispenser is part of an automated teller machine (ATM) and is designed to enable a customer operating an ATM to gain access to envelopes in which deposits of currency, checks or other items of value may be introduced into the ATM through a separate deposit accepting mechanism.

The envelope dispenser includes a generally planar and rectangular frame 10. The frame has two parts as shown in FIG. 1. A first frame part 78 is connected to a second part 80 by fasteners 58. The frame includes a rectangular opening 12. The width of the opening is sized somewhat greater than the width of a depository envelope.

The dispenser includes a door 14 which is sized to cover the opening 12. The door is slidably mounted on the frame 10 so that it can move in a longitudinal direction between a closed first position shown in FIG. 3 and an open second position shown in FIG. 2. In the closed position the door fully covers the opening of the frame. In the open position the user is enabled to access an interior area of the dispenser through opening 12.

The door 14 is slidably mounted on the frame and is constrained to move between guides 30 that extend rearward from a faceplate 40. The faceplate is held to the frame by fasteners 56. A gasket 54 extends between the faceplate and the frame.

The door 14 has a first face 16 and a second face 18. Second face 18 is accessible to a customer through the opening in the faceplate when the door is in the closed position. The door has a slot 20 on its first face which is integral with the door. The door further includes a manually engageable handle 22 which extends outward from the second face 18. Handle 22 enables a user of the ATM to selectively move the door between the open and closed positions when the door is in an unlocked condition.

Figure 2:
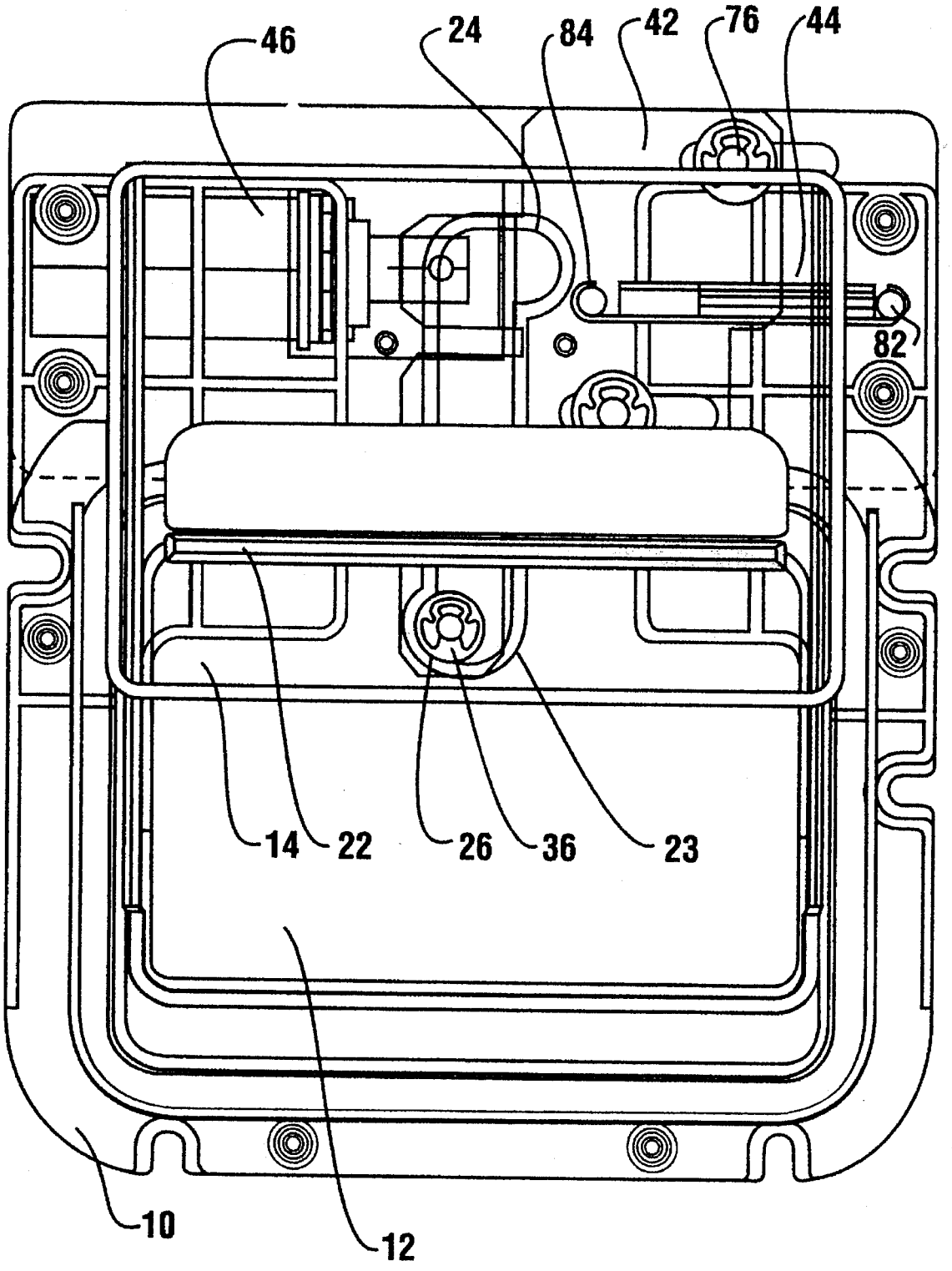
FIG. 2 is a front transparent view of the envelope dispenser door of the present invention shown in the open second position.
Figure 3:
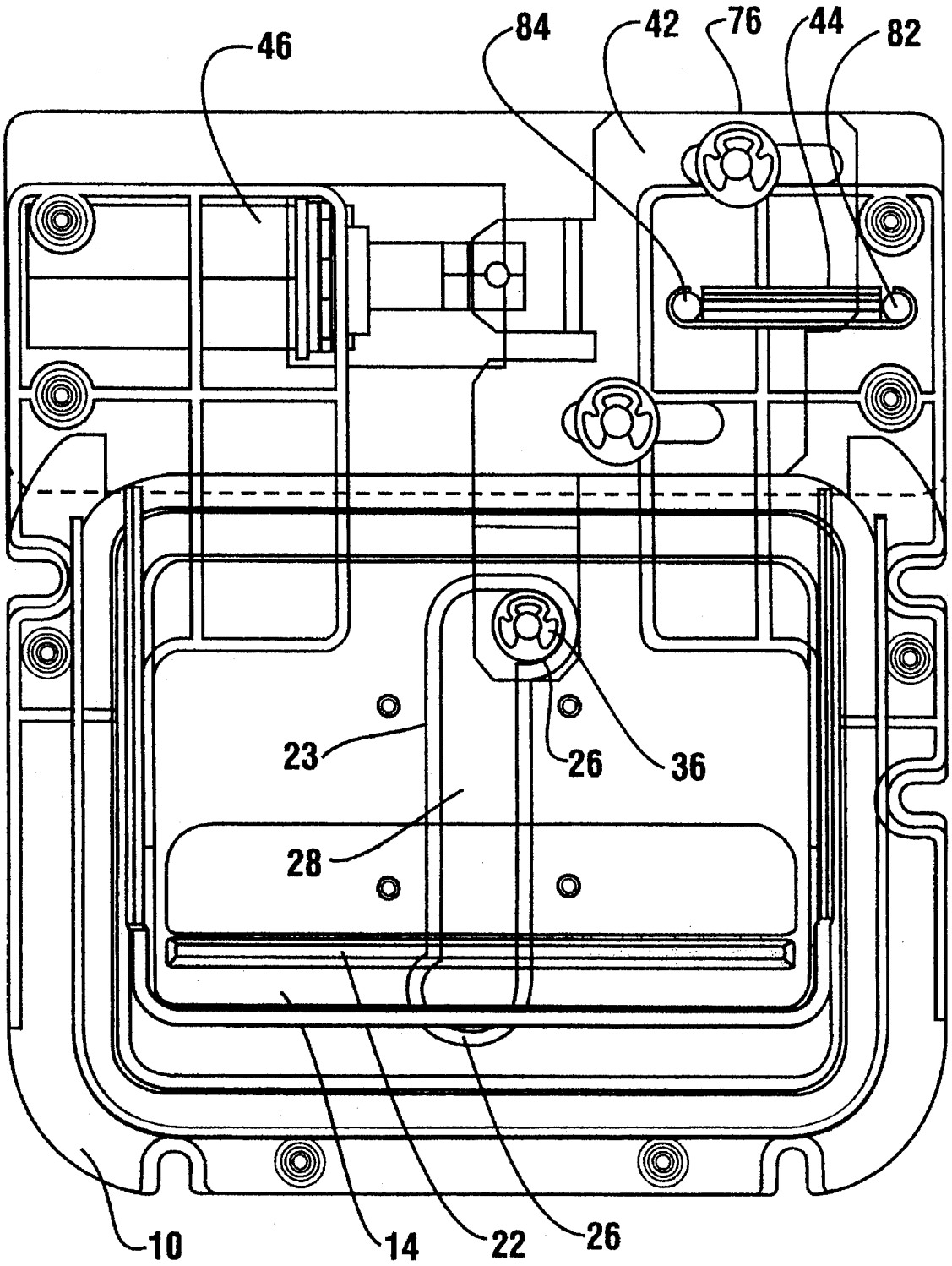
FIG. 3 is a front transparent view of the envelope dispenser door of the present invention shown in the closed first position.
Figure 4:
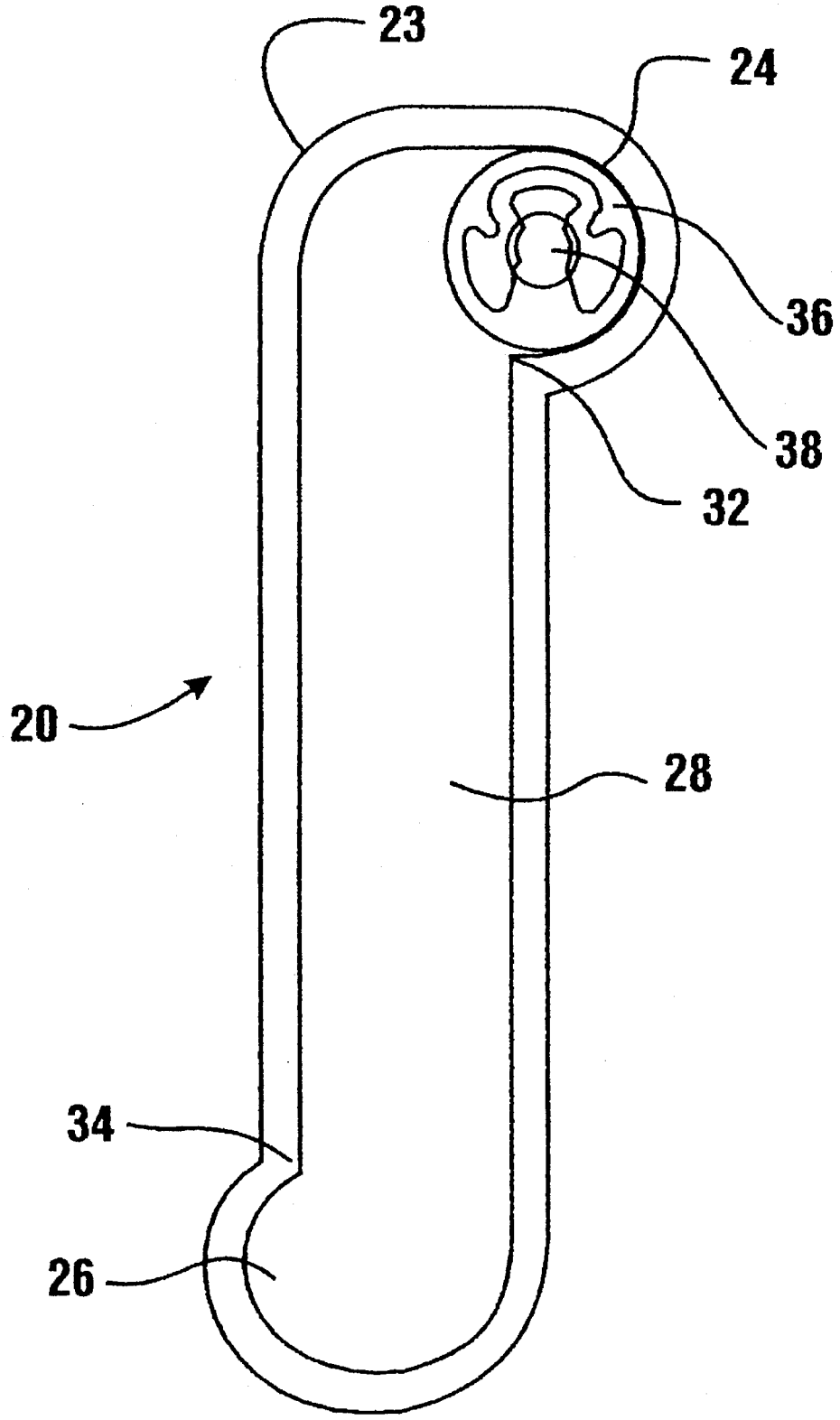
FIG. 4 is a front view of the slot and first member of the present invention.

The slot 20 is best shown in FIGS. 2, 3 and 4. The slot is bounded by a continuous wall 23 which extends inward on the first face of the door. As shown in FIG. 4, the slot has a first notch portion 24 extending in a direction transverse of the longitudinal direction. The slot also has a second notch portion 26 extending in the transverse direction. The second notch is disposed longitudinally from the first notch. The slot further includes a central portion 28 which extends between the first and second notch portions. The first and second notch portions and the central portion of the slot extend generally in a plane parallel with the plane of the first face of the door.

A first shelf surface 32 bounds the lower end of the first notch portion. The first shelf surface extends transversely, generally normal to the central portion of the slot. The slot 20 further includes a second shelf surface 34 which bounds the upper end of the second notch portion of the slot. The second shelf surface extends generally at an obtuse angle relative to the central portion of the slot. The second shelf surface is curved in an arc which ends at said central portion of the slot.

The dispenser includes a second member 42. Member 42 includes two guide slots 66 disposed longitudinally from each other and which extend in the transverse direction. The second member is slidably mounted on the frame on pins 76 which extend rearward from frame part 80. Each pin has mounted thereon a spacer 74 which is rollably movable on the pin. Washers 70 and fasteners 68 mounted on pins 76 hold the second member to the frame while enabling it to move in the transverse direction. As the second member moves, spacers 74 roll in slots 66 facilitating movement thereof. Second member 42 is movable between a front position shown in FIG. 2, a back position shown in FIG. 3 and a middle position intermediate thereof.

The second member further includes a pin 38 which extends from the second member towards the opening of the frame. A first member 36, which is a roller, is rotatably mounted on pin 38 and is held thereto by a clip. First member 36 is engaged in the slot 20 of door 14. A tension spring 44 is connected both to a rearward extending pin 82 on the frame and to a pin 84 on the second member. Spring 44 biases the second member towards the back position.

A solenoid actuator 46 is mounted on the frame and is operatively connected to the second member by a clevis pin 64. The actuator is responsive to an electrical signal generated by the ATM. The electrical signal causes the actuator to move the second member to the left in FIG. 2 towards the forward position.

The envelope dispenser includes an envelope holder 48 which has a bottom wall 72 and two side walls 52. The side walls are spaced to maintain envelopes stacked and guided lengthwise in the longitudinal direction. The envelope holder is attached to a support plate 60 with fasteners 62. The envelope holder includes a front wall having an access opening 86 at the bottom thereof through which the envelopes contained in the holder can be removed manually when the door is in the open position.

The envelope dispenser provides for the automatic regulation of locking, unlocking, holding open and relocking the envelope dispenser door. When the door is locked in the closed position the first member 36 is engaged in the first notch portion 24 of the slot 20. In this position movement of the door in the longitudinal direction is prevented by the engagement of the member 36 with the first shelf surface 32 of the wall 23. The second member 42 is in the back position when the member 36 is engaged in the first notch portion 24.

When a customer using the ATM indicates through an input device such as a button or touch screen that the customer wishes to conduct a deposit transaction requiring an envelope, the door is unlocked by the processor which controls the operation of the ATM energizing actuator 46 with an electrical signal. The actuator moves movable member 36 transversely from said first notch portion 24 against the force of spring 44. Member 36 is moved out of the first notch portion 24 and engages wall 23 on the side opposite the first notch portion which prevents further movement in the transverse direction. In this position the member 36 is positioned in the longitudinally extending central portion 28 of the slot 20 and actuator 46 has moved approximately one-half its stroke. Second member 42 is in the middle position. A customer operating the machine can then move the door 14 in the longitudinal direction to the open position shown in FIG. 2. As the customer opens the door, the member 36 rotates in engagement with wall 23 on the left side of the slot as shown in FIGS. 2–3.

When the door reaches the fully open position the first member 36 moves further in the transverse direction as actuator 46 completes its stroke, and engages a second notch portion 26 of the slot 20. The second member 42 is in the front position. The door will remain in this position until the electrical signal to the actuator is discontinued or until the door is manually closed. With the door in the open position the customer may remove envelopes from the envelope holder through the opening 12.

The door may be closed by manually moving the door downward. When a downward force is applied, the first member 36 engages the obtuse angled shelf surface 34 bounding the second notch portion and is moved against the force of the actuator out of the second notch portion into the central portion 28 of the slot. In this condition the door can be repeatedly manually opened and closed as desired until the actuator 46 is de-energized.

Alternatively, from the open position the door may be closed by de-energizing the actuator. This occurs under the control of the processor when the deposit envelope is sensed as having entered the ATM or at another convenient time in the ATM operating cycle. De-energizing the actuator 46 causes second member 42 to move to the right as shown in FIG. 2. This causes first member 36 to move out of the second notch portion 26 and into the central portion 28 of slot 20 due to the force of spring 44. First member 36 engages the wall bounding the right side of the slot opposite the second notch portion. When this occurs door 14 falls by gravity to the closed position. Once in the closed position, spring 44 biases the second member 42 to the back position wherein first member 36 nests in first notch portion 24. Once first member 36 is in the first notch portion 24, the first shelf surface 32 prevents opening of the door until the actuator is again energized.

It should be noted that movement of door 14 between the open and closed positions is facilitated by first member 36 being rollable in engagement with the interior surface of wall 23 which bounds slot 20. Likewise, movement of second member 42 is facilitated by the rotation of spacers 74 in slots 66.

Although in the drawings the first shelf surface 32 is shown extending normal to the central portion of the notch, in other embodiments it may be made to extend at a somewhat acute angle. As a result, attempts to open the door when the first member is in the first notch portion will tend to pull the first member further into the first notch portion, holding the door locked. The wall 23 in the area of the first shelf surface may be reinforced or made stronger to resist greater opening force.

The envelope dispenser door mechanism of the present invention is reliable, efficient and consumes little space in the interior of the ATM. It is also not subject to breakage due to customers moving it from the open to the closed position at inappropriate times in the machine operating cycle. Although the notch portions of the slot in the preferred embodiment extend in transversely opposed directions, in other embodiments other configurations may be used. Similarly, in other embodiments the central portion of the slot may extend between the notch portions in a direction other than the direction in which the door moves. While in the preferred embodiment the door is moved manually, in other embodiments the opening and closing of the door may be powered by a suitable mechanism.

Thus the apparatus of the present invention achieves the above-stated objectives, eliminates difficulties encountered in the use of prior devices and attains the desirable results described herein.

In the foregoing description, certain terms have been used for brevity, clarity and understanding. However, no unnecessary limitations are to be implied therefrom because such terms are for descriptive purposes and are intended to be broadly construed. Moreover, the descriptions and illustrations herein are by way of examples and the invention is not limited to the exact details shown or described. Further, any feature of the invention which is claimed as a means for performing a function shall be construed as encompassing any means capable of performing the function and shall not be limited to the particular means shown or described herein or their equivalents.

Having described the features, discoveries and principles of the invention, the manner in which it is constructed and operated and the advantages and useful results attained; the new and useful structures, devices, elements, arrangements, parts, combinations, systems, equipment, operations and relationships are set forth in the appended claims.

We claim:

1. An apparatus for an automated banking machine comprising:

a frame supported on said machine;

a door movably mounted on said frame, said door movable in a longitudinal direction between a first position and a second position, the door having a first face, said first face having a slot thereon, said slot generally extending in a plane parallel to said longitudinal direction, said slot including a first notch portion generally extending in said plane and in a transverse direction relative to the longitudinal direction, and a second notch portion generally extending in said plane and in said transverse direction, said second notch portion disposed in said longitudinal direction from the first notch portion, said slot further comprising a central portion generally extending in said plane between said first and second notch portions;

a first member engaged in said slot;

an actuator in operative connection with said first member, wherein said actuator is operable to selectively move said first member engaged in said slot in the transverse direction;

wherein in the first position of the door said first member is engageable in the first notch portion, and wherein in the second position of said door said first member is engageable in the second notch portion.

2. The apparatus according to claim 1 wherein said central portion of said slot extends in the longitudinal direction.

3. The apparatus according to claim 1 wherein said first notch portion is bounded by a first shelf surface extending generally normal to said plane and to the longitudinal direction and wherein when said first member is positioned in said first notch portion, movement of said door to the second position is prevented by engagement of said first member and said first shelf surface.

4. The apparatus according to claim 1 wherein said second notch portion is bounded by a second shelf surface extending generally normal of said plane and at an obtuse angle relative to said longitudinal direction, and wherein when said first member is positioned in said second notch portion movement of said door toward said first position moves said first member in guided engaged relation with said second shelf surface into said central portion of said slot.

5. The apparatus as according to claim 1 wherein said slot is integral with the first face of said door.

6. The apparatus according to claim 1 and further comprising:

a second member movably mounted on said frame, said second member operatively connected to said actuator and said first member, said second member movable in a direction generally parallel of said plane between a forward position, a middle position and a back position;

a spring operatively connected with the second member, wherein said spring biases said second member toward the back position;

wherein in the first position of the door said first member is biased into engagement with said first notch portion by said spring, and wherein said first member is movable responsive to said actuator into said central portion of said slot when said door is in the first position and into said second notch portion when said door is in the second position.

7. The apparatus according to claim 1 and further comprising a manually engageable handle mounted on a second face of the door, whereby the door may be manually moved between said first and second positions by applying force to said handle when said first member is disposed from said first notch portion.

8. The apparatus according to claim 4 and further comprising:

a manually engageable handle attached to a second face of said door, whereby said door is manually moveable between the first and second positions when said first member is disposed from said first notch portion;

and wherein said actuator moves said first member into engagement with said second notch portion when said door is in the second position, and wherein said first member is movable from said second notch portion to said central portion against the force of said actuator responsive to manual movement of said door from said second position toward said first position.

9. The apparatus according to claim 6 wherein said actuator comprises a solenoid responsive to an electric signal whereby said actuator moves said second member toward the forward position responsive to said electrical signal, and the spring moves the second member towards the back position upon the cessation of said signal.

10. The apparatus according to claim 9 wherein said slot is integral with the first face of said door, and wherein said central portion of said slot extends in the longitudinal direction, said first notch portion extends normal to said central portion, said second notch portion is bounded on a side adjacent said first notch portion by a shelf surface that extends at an obtuse angle relative to said central portion and is positioned on a traversely opposed side of said central portion from said first notch portion.

11. The apparatus according to claim 10 and further comprising:

a handle mounted on a second face of said door, whereby, when said door is in the first position, transmission of the electrical signal enables movement of said door responsive to the application of force to the handle to the second position wherein it is releasably held, and wherein the door is movable to said first position from said second position.

12. The apparatus according to claim 6 wherein said apparatus comprises a pair of pins supportably connected to said frame, and wherein said second member comprises a pair of longitudinally disposed member slots, wherein one of said pair of pins extends in a generally normal direction through each of said member slots, whereby said second member is movable in the direction generally parallel of said plane in guided relation on said pins.

13. The apparatus according to claim 1 wherein said slot is bounded by a continuous wall extending generally normal of said plane and wherein said first member is rotatably movable in engagement with said wall.

14. The apparatus according to claim 1 wherein said actuator is operatively connected to said frame wherein movement of said door in said longitudinal direction is prevented by engagement of said first member in at least one of said notch portions.

15. The apparatus according to claim 6 wherein said first member is rotatably mounted on said second member and wherein said first member is rotatably movable in engagement with a wall bounding said slot.

16. The apparatus according to claim 12 wherein each pin includes a spacer rotatably mounted thereon, said spacers extending in said second member slots, whereby said spacers are rotatably engageable with said second member.

17. The apparatus according to claim 1 and further comprising an envelope holder adjacent said frame, wherein said frame includes an opening, wherein said door in said first position is in closing relation with the opening, and wherein in the second position of said door the envelope holder is manually accessible through the opening.

18. An apparatus for an automated banking machine comprising:

a frame, said frame having an opening to an interior area in said machine;

a door movably mounted on said frame, said door sized for closing said opening, said door movable in a longitudinal direction between a first position closing said opening and a second position wherein said interior area is accessible through said opening, the door having a first face and a second face, said first face having a slot thereon, said slot generally extending in a plane and wherein said slot includes a first notch portion generally extending in said plane and in a transverse direction relative to the longitudinal direction, and a second notch portion generally extending in the plane and in the transverse direction, said second notch portion disposed longitudinally from the first notch portion, said slot further comprising a central portion extending between said first and second notch portions;

a first member engaged in said slot;

an actuator in operative connection with said first member, wherein said actuator selectively moves said first member in the transverse direction;

wherein in the first position of the door said first member is engageable in the first notch portion, and wherein in the second position of said door said first member is engageable in the second notch portion.

19. The apparatus according to claim 18, and further comprising a pin in operative connection with said actuator, said first member rotatably mounted on said pin, whereby said first member is rotatable in said slot.

20. The apparatus according to claim 18 wherein said slot includes a first shelf surface bounding said first notch portion of said slot, wherein said first shelf surface extends generally normal of said plane and is abuttingly engageable with said first member to prevent movement of said door from said first position to said second position when said first member is engaged in said first notch portion.

21. The apparatus according to claim 18 wherein said slot includes a second shelf surface bounding said second notch portion of said slot and wherein said second shelf surface extends adjacent the intersection of said second notch portion and said central notch portion, and wherein said second shelf portion is engageable with said first member and moves said first member in guided engagement therewith from said second notch portion to said central portion responsive to movement of said door from said second position toward said first position.

22. The apparatus according to claim 20 wherein said slot includes a second shelf surface bounding said second notch portion of said slot and wherein said second shelf surface extends adjacent the intersection of said second notch portion and said central portion, and wherein said second shelf portion is engageable with said first member and moves said first member in guided engagement therewith from said second notch portion to said central portion responsive to movement of said door from said second position toward said first position.

23. The apparatus according to claim 21 wherein said second shelf surface extends generally normal of said plane and at an obtuse angle relative to said central portion.

24. The apparatus according to claim 18, and further comprising:

an envelope holder located in said interior area, wherein said envelope holder is manually accessible through said opening when said door is in the second position.

25. The apparatus according to claim 18, and further comprising:

an envelope holder located in said interior area, said holder including a bottom wall and side walls, wherein said walls maintain envelopes in alignment with said opening.

26. The apparatus according to claim 18 wherein said slot is bounded by a continuous wall, and wherein said first member is rotatable, and wherein said first member is rotatably movable in engagement with a wall portion bounding said central portion as said door is moved between said first and second positions.

27. The method according to claim 26 wherein said second notch portion includes an angled shelf surface extending at an obtuse angle from the central portion of said slot, and further comprising the step of:

moving said first member in guided engagement with said angled shelf surface of said second notch portion to said central portion of said slot by urging said door toward said first position from said second position.

28. The apparatus according to claim 18 and further comprising a manually engageable handle operatively connected to said second face of said door, wherein said door is movable by manual movement of said handle.

29. The apparatus according to claim 18 and further comprising a second member, said second member disposed in operative relation between said actuator and said first member, and further comprising a pin supported on said frame member and a spacer rotatably mounted on said pin member, and wherein said member comprises an elongated slot, and wherein said pin and spacer extend in said slot.

30. A method for holding an access door of an automated banking machine closed and for selectively enabling opening the door comprising the steps of:

engaging a first movable member in a first notch portion of a slot in operative connection with said door, said first notch portion extending in a transverse direction wherein movement of said door in a longitudinal direction is prevented when said first member is engaged in said first notch portion;

moving said first movable member in the transverse direction from said first notch portion and engaging said first member in a longitudinally extending central portion of said slot;

moving said door in said longitudinal direction to an open position, said first member engaged in said central portion as said door is moved;

and further moving said first member in the transverse direction to engage a second notch portion of said slot whereby said door is held in the open position.

31. The method according to claim 30 wherein said door comprises a handle, and wherein said step of moving said door in the longitudinal direction comprises manual engagement of said handle and movement of said door thereby.

32. The method according to claim 30 wherein said automated banking machine comprises an envelope holder in an interior area thereof, and wherein said envelope holder is manually accessible through an opening to said interior area, wherein said opening is in an open condition when said door is in the open position, and further comprising the step of manually accessing said envelope holder through said opening.

33. An automated banking machine comprising:

a frame supported on said machine;

a door movably mounted on said frame;

a slot in operative connection with said door, wherein said slot generally extends in a plane, and wherein said slot includes a central portion, wherein said central portion extends generally in a direction, and wherein said door is movable relative to said frame generally in said direction, and wherein said slot further comprises a first notch portion and a second notch portion, wherein said second notch portion is disposed in said direction from said first notch portion, and wherein said first and second notch portions of said slot extend generally transverse of said central portion;

a first member, wherein said first member is engaged in said slot; and an actuator in operative connection with said first member, and wherein said actuator is operative to selectively engage said first member in said first notch portion or said second notch portion, whereby movement of said door is selectively restricted.

34. An automated banking machine, comprising:

a frame supported on said machine;

a door movably mounted on said frame;

a first member means, and a slot means in operative connection with said door, said first member means for engaging said slot means, and said slot means for engaging said first member means, wherein said slot means includes in generally co-planar relation a first notch portion, a second notch portion and a central portion, wherein said central portion extends in a first direction and in intermediate relation between said first and second notch portions;

an actuator means for selectively positioning said first member means in said slot, wherein said door is enabled to move generally in said first direction on said frame when said first member means is positioned in said central portion, and wherein movement of said door in said first direction is restricted when said first member means is positioned in one of said first or second notch portions.

35. An automated banking machine comprising:

a frame supported on said machine;

a door movably mounted on said frame;

a surface including a slot therein, said surface in operatively fixed connection with one of either said door or said frame, and wherein said slot includes a longitudinally extending central portion, and said slot further includes a first notch portion and a second notch portion, wherein each of said first and second notch portions of said slot extend generally transversely of said central portion, and wherein said first notch portion is longitudinally disposed from said second notch portion;

a first member, wherein said first member is engaged in said slot and movable relative to said slot, and wherein said first member is in operatively supported connection with said other of either said door or frame not in operatively fixed connection with said surface; and an actuator in operative connection with either said first member or said surface, and wherein said actuator is operable to move said first member relative to said slot, and wherein said actuator is operable to selectively engage said first member in either said first notch portion, said central portion or said second notch portion of said slot, wherein said door is longitudinally movable on said frame when said first member is engaged in said central portion and wherein when said first member is engaged in one of said first or second notch portions longitudinal movement of said door is restricted.

* * * * *